United States Patent [19]

Jones

[11] Patent Number: 4,480,342

[45] **Date of Patent: * Nov. 6, 1984**

[54] PASSIVE DISPENSER

[75] Inventor: Gregory R. Jones, Cincinnati, Ohio

[73] Assignee: The Drackett Company, Cincinnati, Ohio

[ * ] Notice: The portion of the term of this patent subsequent to Mar. 1, 2000 has been disclaimed.

[21] Appl. No.: 457,995

[22] Filed: Jan. 14, 1983

[51] Int. Cl.[3] ..... E03D 9/02

[52] U.S. Cl. ..... 4/228; 4/227; 222/424.5

[58] Field of Search ..... 4/222, 227, 228; 222/424.5, 416, 204, 57, 54

[56] References Cited

U.S. PATENT DOCUMENTS 1,175,032 3/1916 Williams ..... 4/228

FOREIGN PATENT DOCUMENTS 11469 of 1891 United Kingdom ..... 4/228

*Primary Examiner*—Henry K. Artis

*Attorney, Agent, or Firm*—Charles Zeller

[57] ABSTRACT

The present invention provides a passive dispenser having dual sections for use in a toilet tank in which a disinfectant solution to be dispensed is stored in one section and substantially isolated from the water in the toilet tank, the section comprising a product chamber having a venting means and a refill/discharge pathway. The refill/discharge pathway is vented to the atmosphere and has an inclined conduit extending downwardly from the top portion of the pathway to the product chamber. Hydrostatic head obtained by use of refill/discharge pathway venting conduit in conjunction with the inclined conduit retards the outflow of solution from said product chamber during quiescent periods. Constriction means in the refill/discharge pathway venting conduit is preferred to provide turbulence during the refill cycle. In the other section of the dispenser, a soluble composition comprising a detergent, deodorant or other additive materials is stored. Both compositions are dispensed into the toilet tank simultaneously when the toilet is flushed.

17 Claims, 9 Drawing Figures

PASSIVE DISPENSER

DESCRIPTION

1. Field of Invention

The present invention relates to a passive dispenser, adapted for placement in a body of liquid, for dispensing materials, such as toilet tank additives, e.g., disinfectants, detergents, dyes, fragrances, and the like, in solution form from the dispenser in response to a lowering of the height of the body of liquid from a first elevation to a second elevation. More specifically, the present invention relates to a passive dispenser comprising two separate dispensing sections codispensing respective solutions simultaneously, said dispenser having no moving parts.

2. Background of the Invention

Numerous devices for dispensing a cleaning or disinfectant solution into a toilet tank for flow into the toilet bowl when the tank is flushed are known. These devices can be characterized as active dispensers, wherein valves or other mechanisms are used to initiate flow from the dispenser when the toilet tank is emptied to a given level, or as passive dispensers, wherein no moving parts are employed, the flow of a predetermined amount of solution from the dispenser being actuated solely by a lowering of the height of the water contained in the tank. Exemplary of the former class, i.e., active dispensers, are devices described in U.S. Pat. Nos. 1,307,535 to Ciancaglini; 2,692,165 to Sinkwich; 3,341,074 to Pannutti; 3,698,021 to Mack, et al; 3,778,848 to Foley; 4,036,407 to Slone, and 4,244,062 to Corsette. A disadvantage of these active-type dispensers is a tendency for the valve or other mechanical actuating means to become clogged, and thus fail in an open or closed position. Passive type dispensers overcome this particular problem inasmuch as there are no moving parts that can fail to operate in the proper manner.

In one type of such passive dispensers, the dispenser is alternatively flooded when the tank is filled and emptied (at least partially) by siphoning solution therefrom when the tank is flushed. See, for example, U.S. Pat. Nos. 650,161 to Williams, et al; 969,729 to Smith; 1,144,525 to Blake; 1,175,032 to Williams; 1,213,978 to Thornton; 1,987,689 to Lewis, and 3,339,801 to Hronas. In another type of passive dispenser, the dispensing device is alternately flooded and drained gravitationally, as illustrated in U.S. Pat. Nos. 991,825 to Bogie; 3,121,236 to Yadro, et al; 3,423,182 to Klasky; 3,504,384 to Radley, et al; 3,545,014 to Davis; 3,604,020 to Moisa; 3,618,143 to Hill, et al; 3,769,460 to Castronovo; 3,772,715 to Nigro; 3,781,926 to Levey; 3,867,101 to Herring; 3,943,582 to Daeninckx, et al, and 3,952,339 to Baur, et al.

U.S. Pat. Nos. 2,688,754 to Willits, et al; 3,073,488 to Komter; 3,784,058 to Buchtel; 3,864,763 to Spransy; 3,895,739 to Buchtel, and 3,965,497 to Corsette and U.K. Pat. No. 705,904 disclose toilet chemical dispensers wherein the head of liquid solution within the container forces solution therefrom when the tank water level falls below the spout of the dispenser. Filling the tank above the discharge spout prevents solution from leaving the dispenser. In a further type of passive dispenser, the solution to be dispensed is connected to a pressurized water supply such as the trap refil pipe in a toilet tank. See, for example, U.S. Pat. No. 3,407,412 and 3,444,566 to Spear, wherein the direction of flow alternates in labyrinth passages.

Passive dispensers using air locks, i.e., pockets of air to isolate the solution, particularly a disinfectant solution, from tank water during quiescent periods in a toilet tank are also known. See, for example, U.S. Pat. Nos. 4,171,546; 4,186,856, and 4,208,747 to Dirksing and U.S. Pat. Nos. 4,216,027 to Wages; 4,251,012 to Owens, et al; 4,281,421 to Nyquist, et al; 4,305,162 to Cornelisse, Jr. et al, and 4,307,474 to Choy.

SUMMARY OF THE INVENTION

It is an object of the present invention to codispense a first solution and a second solution into a body of liquid from a passive dispenser having separate sections for each solution.

It is a further object of the invention to provide a dispenser containing a cleaning solution and a disinfectant solution in substantial isolation one from the other, said solutions being dispensed into a body of liquid in response to a lowering of the level of said body of liquid from a first elevation to a second elevation.

Another object of the present invention is to maintain the in-tank concentrations of the surfactant solute and especially of the disinfectant solute at low levels during quiescent periods, i.e., between flushes, which concentrations arise in view of diffusion or migration of said solutes from their respective chambers of the dispensing device.

Another object of the invention is to avoid interaction of said first and second solutions prior to codispensation of same.

A primary objective of the invention is to provide a passive dispenser having the above cited objects and advantages suitable for use in a toilet tank. Upon flushing the respective solutions are codispensed into the tank water, and subsequently into the toilet bowl, the dispenser being suitable to deliver a multiplicity of uses.

These and other objects and advantages of the present invention will be more fully understood upon inspection of the drawings and upon reading of the detailed description, a summary of which follows.

The passive dispenser of the present invention comprises two dispensing sections, the first dispensing section comprising a first product chamber for containing, preferably, a cleaning solution comprising surfactant, fragrance and dye, and the second dispensing section comprising a second product chamber for containing, preferably, a disinfectant solution.

The first product chamber has a refill/discharge pathway providing fluid communication between said chamber and the body of liquid, said pathway entering the chamber a predetermined distance below the top thereof. The pathway comprises serially a bottom portion having an inlet/outlet port, a vertical central portion, and an upper portion. An inclined conduit extends downwardly from the upper portion and into the first chamber at said predetermined distance, while a vent conduit extends upwardly from the upper portion to the atmosphere. The first chamber is provided with a separate vent conduit extending from the top of the chamber to the atmosphere. In the preferred embodiment, the vent from the refill/discharge pathway is provided with a constriction adapted to induce a jetting of liquid into the chamber through the inclined conduit during the filling of the dispenser.

The second product chamber has an inlet/outlet pathway providing fluid communication between said chamber and the body of liquid, said pathway entering the first chamber at a predetermined distance below the top thereof. The pathway configuration is adapted to discharge the volume of solution above the inlet of the pathway by siphon flow. The second chamber is further provided with a vertical vent conduit that extends from the top of said chamber, and which provides fluid communication between said chamber and the atmosphere when the dispenser is in operative position in the body of liquid.

DETAILED DESCRIPTION OF THE INVENTION

Figure 1:
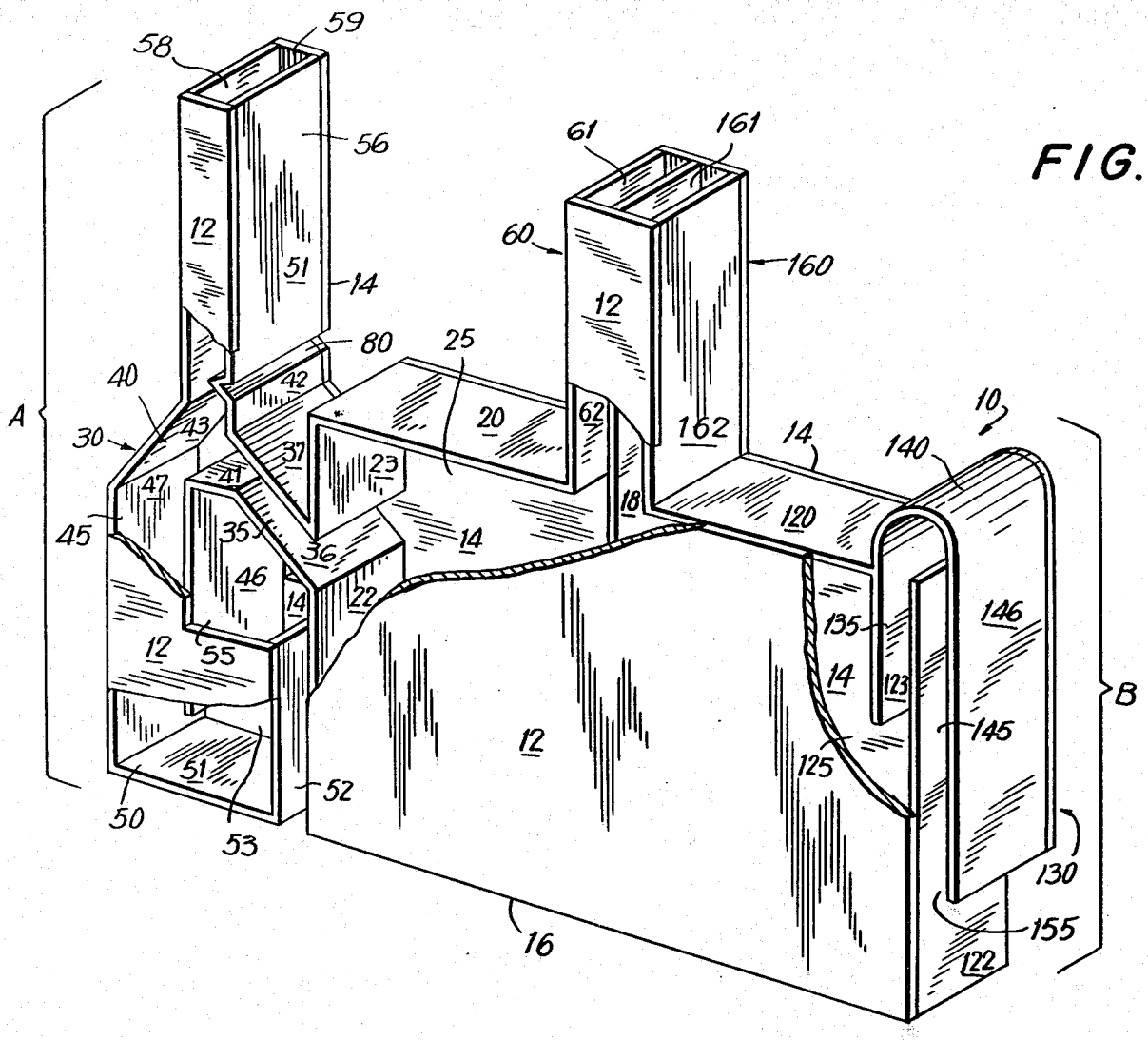
FIG. 1 is a partially cut-away perspective view of the passive dispenser of the present invention.

According to the present invention, there is provided dual section passive dispensing device that codispenses a first solution and a second solution simultaneously into a body of liquid, i.e., a toilet tank, upon a lowering of the liquid level from a first elevation to a second elevation, e.g., upon flushing. When used in a toilet tank, the combined solutions then flow into the toilet bowl. The dispensing sections are separate one from the other, both sections being designed so that concentrations of the surfactant and disinfectant in the body of liquid arising from the migration or diffusion of respective solutes into the tank water during quiescent periods, i.e., periods between flushes, are low.

The material contained in one dispensing chamber is a water-soluble disinfectant containing cake, bar, packet, or tablet (hereinafter collectively referred to as the disinfectant cake) that forms, upon dissolution, a concentrated disinfectant solution within said chamber, which solution is available for release into the tank upon a lowering of the tank water level from a first elevation to a second elevation. The other chamber contains a water-soluble surfactant containing cake, bar, packet, or tablet (hereinafter collectively referred to as the surfactant cake) that forms, upon dissolution, a concentrated surfactant solution with said chamber, which solution is available for simultaneous release into the tank when water level is lowered. Only a portion of the disinfectant and surfactant solutions contained within their respective chambers is dispensed each time the tank water level is lowered.

The disinfectant cake comprises a disinfectant agent, for example, a halogen-releasing agent such as an alkali or alkaline earth metal hypochlorite, especially sodium, potassium and calcium hypochlorite. Other disinfectant agents that are used are, for example, chloramine derivatives, i.e., sodium benzenesulfonchloramine, sodium para-toluenesulfonchloramine, and para-toluenesulfondichloramide; halogenated hydantoins, i.e., 1,3-dichloro-5,5-dimethylhydantoin, 1-bromo-3-chloro-5,5-dimethylhydantoin, and 1,3-dibromo-5,5-dimethylhydantoin; and isocyanurates, i.e., sodium dichloroisocyanurate and trichloroisocyanuric acid. The disinfectant cake can also include other constituents such as binders to provide strength to the cake, both in the dry state to facilitate handling and in the wet state to prevent disintegration; tabletting lubricants, and buffering agents. Dyes are specifically not incorporated in the disinfectant cake in view of the chemical interaction with the disinfectant agent, an oxidizing agent.

Preferably, the disinfectant cake comprises a disinfectant that is a halogen-releasing agent of relatively low solubility, for example, para-toluenesulfondichloroamide; 1,3-dichloro-5,5-dimethylhydantoin; 1-bromo-3-chloro-5,5-dimethylhydantoin, 1,3-dibromo-5,5-dimethylhydantoin, and trichloroisocyanuric acid. Solubility of the preferred disinfecting materials is less than 5.0 gms./100 gms. water at 77° F., preferably less than 2.0 gms./100 gms., most preferably less than 1.0 gm./100 gms.

Especially preferred disinfectants are N-halogenated hydantoin compounds, i.e., 1-bromo-3-chloro-5,5-dimethylhydantoin (BCDMH). N-halogenated compounds disinfectant agents of the type referred to in Paterson, U.S. Pat. No. 3,412,021, which compounds are in agglomerate form and have a solubility in water of from about 0.0001 to about 1% by weight at 20° C., can be used. The Paterson patent is incorporated herein by reference thereto. BCDMH in agglomerated form has a solubility of about 0.15% by weight at 77° F.

The disinfectant cake contains an amount of disinfectant that provides a useful dispenser life of from about two to three weeks to about several months, based on normal household use of about 10 to 20 flushes per day. Typically, this criteria suggests a disinfectant cake of from about 15 to 100 grams, the disinfectant therein being at least 30% by weight. The remainder comprises on a weight basis up to 70% binder, less than 10% buffering agent, and up to about 5% by weight lubricant. The wide variation in cake size and disinfectant amount for the typical disinfectant cake exists in view of different solubilities of the disinfectant agents and in view of the varying bacteriostatic activities thereof.

The surfactant cake comprises a cleaning composition comprising one or more surfactants selected from the group consisting of anionic, nonionic, cationic, and amphoteric surfactants. Other constituents that can be included in the surfactant cake are dyes, fragrances, binders, thickeners, fillers, solubility control agents and buffering agents. Binders are typically not required in the surfactant cake, the active materials generally forming cakes of suitable dry and wet strength.

Preferred anionic surfactants include alkali metal alkyl, alkenyl and alkylaryl sulfate and sulfonate salts of the general formulas $RSO_3M$ and $RSO_3M$, respectively, wherein R is an alkyl or alkenyl group of 8 to 20 carbon atoms, or an alkylaryl group, the alkyl portion of which is straight or branched aliphatic chain of 9 to 15 carbons, the aryl portion of which is benzyl or phenyl, and M is an alkali metal, e.g., sodium, potassium or lithium, or an amine or ammonium. The anionic surfactant may also be an alkali metal salt alkyl phenol ethylene ether sulfate with between 1 to 10 ethylene oxide units per molecule, the alkyl radical containing from 8 to 12 carbon atoms. A preferred anionic surfactant is sodium alpha-olefin sulfonate available as flakes from Lakeway Surfactant Co. under the trademark Siponate 301-10F.

The nonionic surfactant may be an alkylene oxide condensate, an amide or a semi-polar agent. The alkylene oxide condensates include polyethoxylated aliphatic alcohols, the alkyl chain having between 8 to 20 carbon atoms, and the number of ethylene oxide units between 4 and 12; polyethoxylated alkyl phenols wherein the alkyl group contains between 6 and 12 carbon atoms and the number of ethylene oxide units is between 5 to 25; difunctional block polymers of polyoxyalkylene derivatives of propylene glycol and tetrafunctional polyether block polymers of polyoxyalkylene derivatives of ethylenediamine. Amide-type nonionics are the ammonia and ethanolamides of fatty acids whose acyl portion contains from 8 to 18 carbon atoms, while the semi-polar type nonionics are the amine oxides, phosphine oxides and sulfoxides. Preferred nonionics are condensates of ethylene oxide with hydrophobic bases formed by condensing propylene oxide with propylene glycol. Exemplary of this surfactant group are the surfactants sold under the trademark Pluronic by BASF Wyandotte, e.g, Pluronic F-108 and Pluronic F-127. Also preferred are tridecyl- and decyloxypoly(ethyleneoxy) ethanols sold under the trademark Emulphogene by GAF Corporation, e.g., Emulphogene TB-970, a tridecyloxypoly(ethyleneoxy) ethanol in flake form.

Cationic surfactants can be incorporated into the surfactant cake. Because cationic surfactants are typically incompatible with anionic surfactants, the use of cationics is generally limited to anionic free cakes, wherein the cationic surfactant is incorporated to provide germicidal activity or to regulate surfactant solution properties. Exemplary of cationic surfactants suitable herein are alkyl dimethyl benzyl ammonium chlorides, i.e., Ammonyx T and BTC 1326 sold by Onyx Chemical Company; alkyl dimethyl-1-naphthy-methyl ammonium chlorides, i.e., BTC-1100R sold by Onyx Chemical Company, and the Triton RW-Series surfactants, which have the chemical formula $RNH(OCH_2CH_2)_nOH$, wherein n=1 to 15.

Suitable amphoteric surfactants include betaine derivatives, e.g, coco betaines such as Ampho B11-34 sold by Capital City Products, cocoamidopropyl betaine such as Cycloteric BETC-30 sold by Cyclo Chemicals; imidazolines, e.g., lauric-based imidazoline amphoteric, monocarboxylic sold by Quad Chemical under the trade name Carsonam L; and the diethanolamine and sodium salts of dicarboxylic tall oil and coconut oil derivatives, e.g., Miranol C 2M sold by Miranol Chemical Co. The amphoteric surfactants are preferably used in combination with the anionic or nonionic surfactants and are incorporated within the cake or regulate foaming and other properties of the surfactant solution.

The surfactant cake contains an amount of surfactant that provides cleaning over the useful life of the dispenser, as noted above with respect to the disinfectant cake. A typical surfactant cake ranges from about 30 to about 150 grams, the surfactant therein being at least about 30% by weight. Preferably dye and fragrance are incorporated into the surfactant cake, each being present in amounts between 2 to 15% of the cake by weight. The amount of dye and fragrance incorporated within the cake is, of course, dependent upon the efficacy of the agent selected, and should be sufficient to provide activity for the useful life of the dispenser. A particularly preferred dye is FD&C Blue No. 1, C.I No. 42,090. Preferably, the surfactant cake is a combination of several surfactants, thereby regulating the dissolution characteristics of the cake as well as the physical properties of the surfactant solution. A preferred surfactant cake comprises between about 15 to 50% Pluronic nonionic surfactant, between 10 to 40% Emulphogene nonionic surfactant, about 10 to 40% alpha-olefin sulfonate anionic surfactant, between 5 to 12% dye, and from 5 to 12% fragrance.

Figure 2:
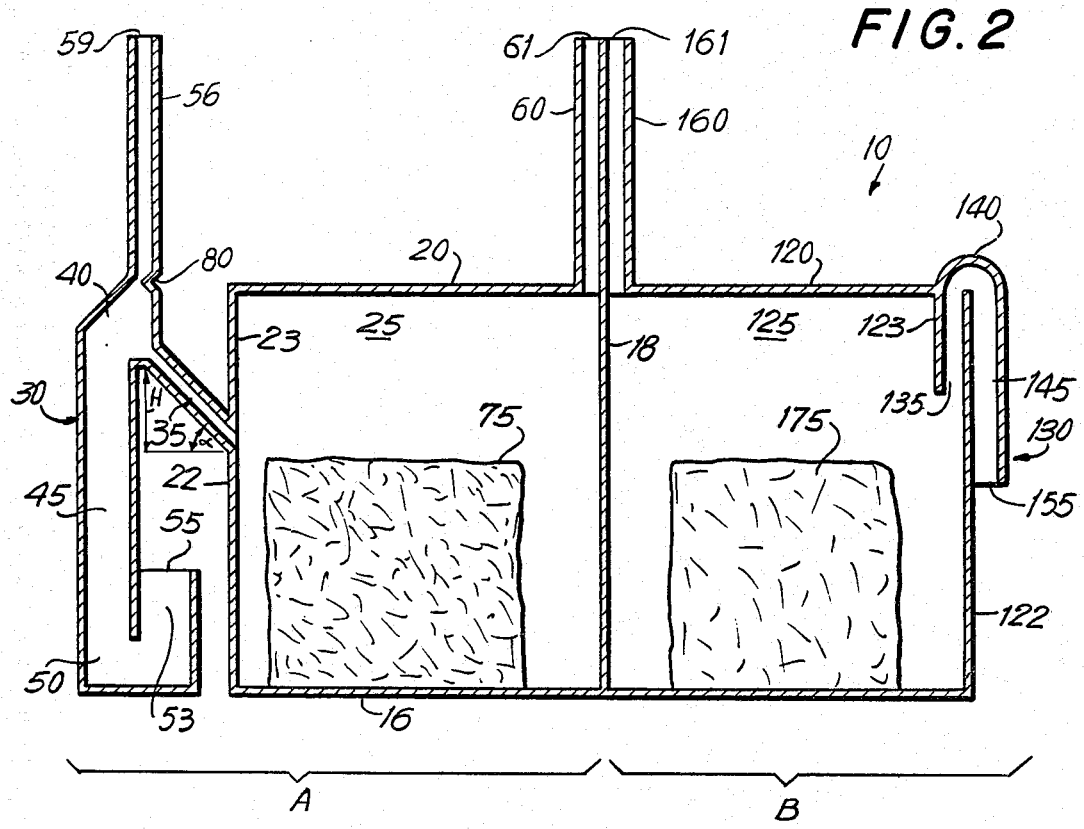
FIG. 2 is a front elevational view of the dispenser in FIG. 1 with wall 12 removed therefrom.

Referring to the drawings, FIG. 1 is a perspective view of the dispenser 10 of the present invention, the front side wall 12 of which is partially broken away to illustrate certain of the interior features of the dispenser. The dispenser 10 has two dispensing sections A and B, said sections being separated by common wall 18. Front wall 12, back wall 14 and bottom wall 16 are also common to each section A and B. Front wall 12 and back wall 14 are considered to cover the entire front and back surfaces, respectively, of the dispenser 10, including pathways and vents. FIG. 2 is a front view of the dispenser 10 with front wall 12 removed.

Referring to FIG. 1, dispensing section A comprises a product chamber 25 defined by front wall 12, back wall 14, bottom wall 16, common wall 18, top wall 20, and side wall segments 22, 23; a refill/discharge pathway 30 as in hereinafter described, and a vent conduit 60 having an outlet port 61 in the top thereof, said vent conduit 60 extending upwardly from the top wall 20 and being defined by front wall 12, back wall 14, common wall 18, and side wall 62 opposite wall 18.

Referring to both FIG. 1 and FIG. 2, the refill/discharge pathway 30 is seen to be a conduit having the general configuration of the letter C, which conduit is vented from the top thereof. The pathway 30 comprises an inclined conduit portion 35 defined by walls 36 and 37; a top portion 40 defined by walls 41, 42 and 43; a vertical portion 45 defined by walls 46 and 47; a bottom portion 50 defined by walls 51 and 52, said bottom portion being in fluid communication with the tank water through inlet/outlet port 55, and vent 56 defined by walls 51 and 58, vent 56 having an outlet port 59 in the top thereof. As mentioned above, the pathway 30 is also defined by front wall 12 and back wall 14.

Dispensing section B comprises a product chamber 125 defined by front wall 12, back wall 14, bottom wall 16, common wall 18, top wall 120, side wall segments 122, 123; an inlet/outlet pathway 130 as hereinafter described, and a vent conduit 160 having an outlet port 161 extending upwardly from the top wall 120 and being defined by front wall 12, back wall 14, common wall 18, and side wall 162 opposite wall 18. With respect to dispensing section B, the inlet/outlet pathway 130 comprises a conduit 135 interior of chamber 125 defined by walls 122 and 123, a conduit 145 exterior of chamber 125 defined by walls 122 and 146, said conduit 145 having an inlet/outlet port 155 in the bottom thereof, and an arcuate portion 140 joining said conduits 135 and 145 proximate the top 120 of dispensing section B.

Although the conduit portion of pathway 30 is C shaped as shown in FIGS. 1 and 2, other configurations can be used. For example, the bottom portion 50 can be omitted entirely, the vertical portion 45 having an outlet port 55 at the bottom thereof. Similarly, the bottom portion 50 could face outwardly, thereby providing an S-shaped configuration to the conduit. The dispenser 10 may be suspended in the body of liquid by hanging means (not shown) from the rim of the tank, e.g., the toilet tank.

Bottom portion 50 is shown in FIGS. 1 and 2 with a vertical end portion 53 bounded by walls 46 and 52. The vertical end portion 53 serves to limit or prevent seepage of solution from the dispenser section A if the water level in the tank decreases slightly as to displace a small portion of the product solution from chamber 25 into pathway 30.

As shown in FIG. 2, material to be dispensed from chambers 25, 125 is contained in cakes 75 and 175, said cakes having dimensions that do not occupy the entire interior space of the respective chambers. The material to be dispensed may also be contained in forms other than a cake or bar, for example, as a gel or semisolid, as a coating or impregnated within a suitable carrier, or as a granular material within a water-permeable membrane. These other forms are deemed to be equivalents of the cakes shown in FIG. 2. Cake 75 contained in chamber 25 preferably contains a disinfectant material of the type mentioned previously. Conversely, it is preferred to incorporate the surfactant material, along with other, optional adjuvants into the cake 175 contained in chamber 125.

In the vent conduit 56 of pathway 30, it is preferred to include, as shown in the drawings, a constriction 80, which may be in the form of a standard orifice, a vee notch, a square-edged orifice, venturi, or the like. During refill of the dispenser, the upper portion 40 of the pathway fills rapidly, the constriction jetting water through the inclined conduit 35. The jet of water through conduit 35 increases turbulence in the chamber 25, and aids in the dissolution of the cake 75. However, the constriction is not essential. Indeed, a small diameter vent 60 could be used in the lieu of the constriction 80. The inlet/outlet pathway 130 can have the same configuration as the refill/discharge pathway 30, although this is not essential when the material inside of chamber 125 is a surfactant cake of moderate solubility.

Referring to FIG. 2, the height H of the inclined conduit 35 is limited in its upper range by constraints on practical dispenser dimensions, while the lower limit of H is about ¼ inch. Preferably, the height H is between ½ and two inches. The angle which inclined conduit 35 makes with the vertical axis of the product chamber 25 is critical only insofar as compact design of the dispenser limits the horizontal distance between the pathway 30 and the chamber 25. For reasonably compact designs with values of H below 2 inches, the angle is between about 10 to about 80°, preferably between 10 and 60.

Figure 3:
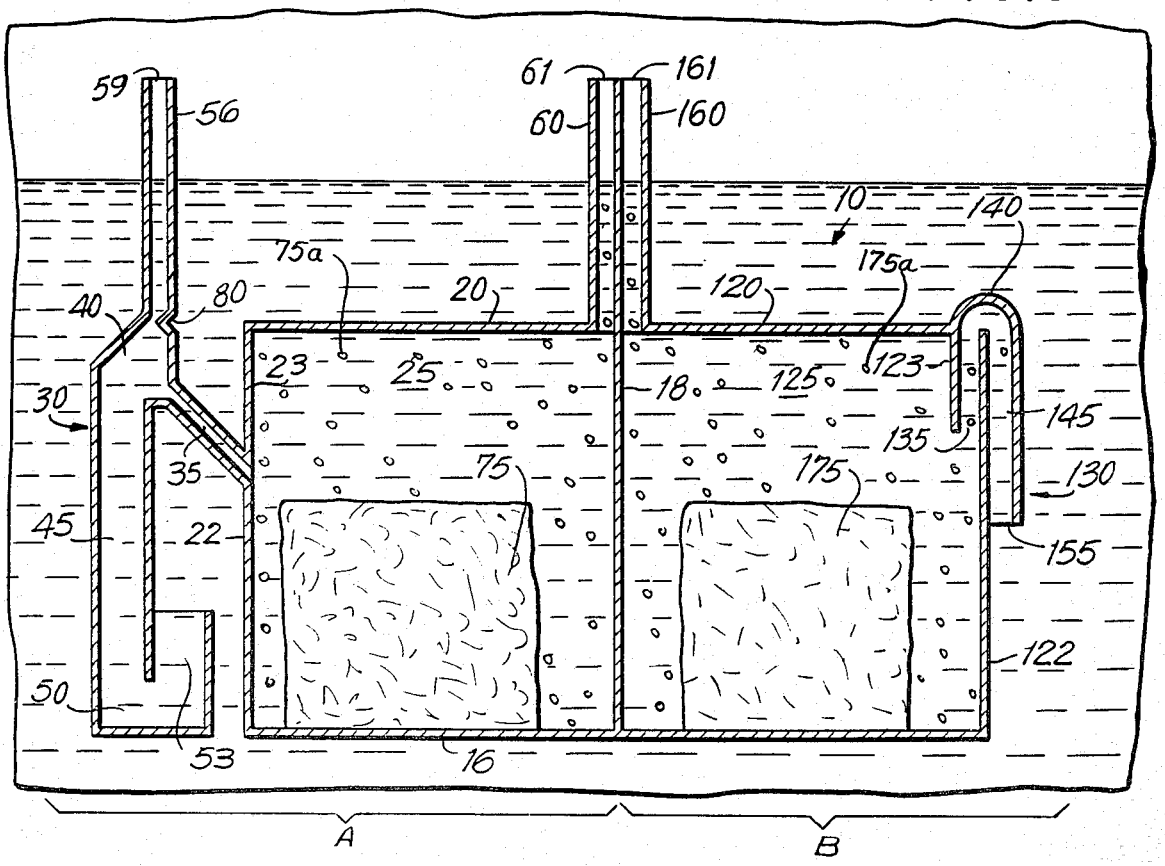
FIGS. 3–8 are simplified front elevational views of the dispenser in FIG. 1 with front wall 12 removed therefrom, showing various stages of the refill/discharge cycle.

The operation of the present dispenser is shown sequentially in FIGS. 3 to 6. In FIG. 3 the toilet tank (not shown) is full of water, representing a between-flushes situation, i.e., the toilet tank is in a quiescent state. The solution 75*a* resulting from contact between water and cake 75 is confined within product chamber 25, venting conduit 60 and the lower end of inclined conduit 35 of section A. The remainder of refill/discharge pathway 35 and pathway vent conduit 56 is filled with essentially solute-free water up to water level L. In section B the solution 175*a* formed from contact between water and cake 175 is stored within product chamber 125. Because product chamber 125 is in fluid communication with the tank through pathway 130, the detergent or deodorant solution may migrate or diffuse into the tank as a result of concentration gradients existing within said chamber 125.

It is important during the quiescent period shown in FIG. 3 that the disinfectant material be contained within the product chamber therefor as completely as possible. Conversely, while the surfactant-dye-fragrance materials should be retained essentially within the product chamber therefor, a small amount of these materials, especially the fragrance and dye constituents, may migrate into the tank water. In solution the surfactant material tends to form a concentration gradient that increases towards the bottom of the chamber 125. Furthermore, the viscosity of the concentrated surfactant solution 175*a* within the chamber 125 is such that the downward settling of the surfactant material is favored rather than upward diffusion. Hence, by providing a vertical barrier over which the solution flows upon discharge, e.g., the top of side wall 122, coupled with the properties of the dissolved surfactant material, the rate and amount of migration of surfactant material to the tank is kept well within tolerable levels. Viscosity of the concentrated surfactant solution, which varies over the life of the product, is typically from about 50 to about 1,200 cp. at 25° C., preferably from about 100 to about 800 cp., and surface tension is typically from about 30 to about 50 dynes/cm. at 25° C., proximate the bottom of the chamber.

Conversely, the disinfectant cake 75 forms a solution 75*a* which is of low viscosity, proximate to that of water. Hence, the disinfectant solution 75 is more apt to migrate from a product chamber. In view of the properties of the disinfectant solution 75*a*, and because it is preferred to isolate said disinfectant solution from the tank water insofar as possible, the construction of pathway 30 is used. Although applicant does not wish to be bound by any theory of operation, it is believed that the head of liquid above the lower end of the inclined conduit 35 provided by vent conduit 56, as well as the vertical height barrier of the inclined conduit 35, is operative to retard the migration or diffusion of disinfectant solution 75*a* from chamber 25. The reduction in the rate of diffusion of disinfectant solution is also a function of the disinfectant used, there being a more pronounced reduction with disinfectants of low solubility in water, as identified above.

Figure 4:
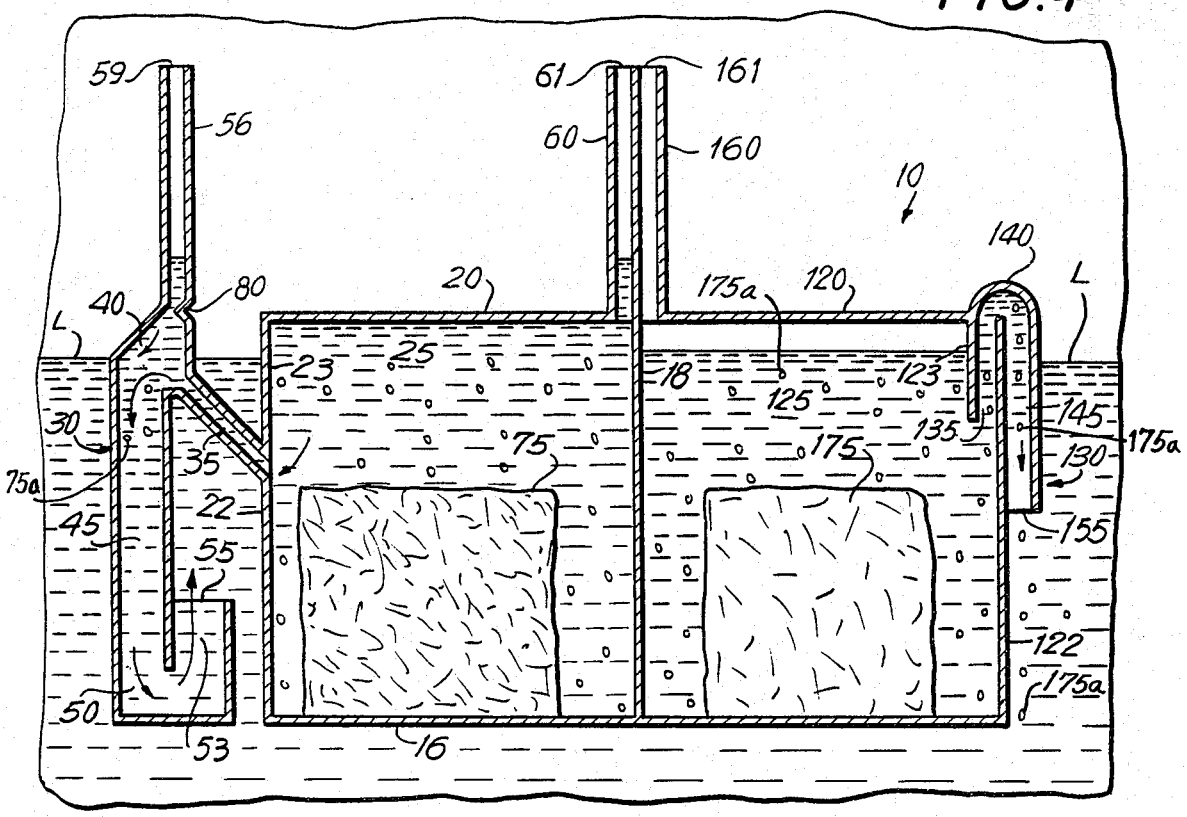
Figure 5:
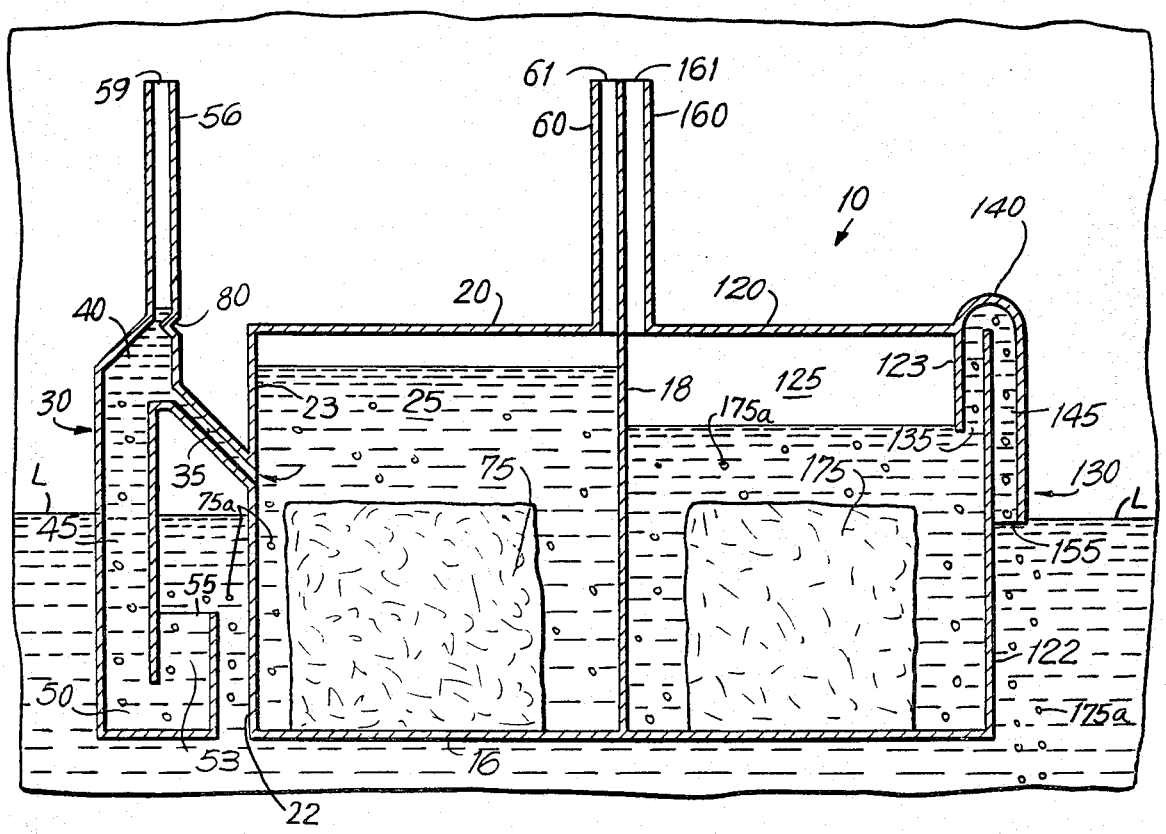

FIG. 4 shows the first stage of the flush cycle. When the toilet tank is flushed, the water level L drops rapidly as compared to the liquid levels in the dispenser 10. As the difference between these relative levels increases, the hydraulic head of liquid within section A of the dispenser 10 increases, resulting in flow, slowly at first and then more rapidly, of solution 75 from section A to the tank through refill/discharge pathway 30 and exit/inlet port 55. As shown in FIG. 4, flow of liquid in from vents 56, 60 has just begun, the relative differences in liquid levels therein being small. As the level continues to fall, and as a consequence of the increase in hydraulic head between the level L in the tank and the level of solution in the chambers 25, 125, the rate of flow from sections A and B of the dispenser increases. In FIG. 5 the height of liquid in vent 56 is still above the height of liquid in chamber 25, the top portion of said chamber 25 now having a blanket of air therein, the air entering through vent 60.

Figure 6:
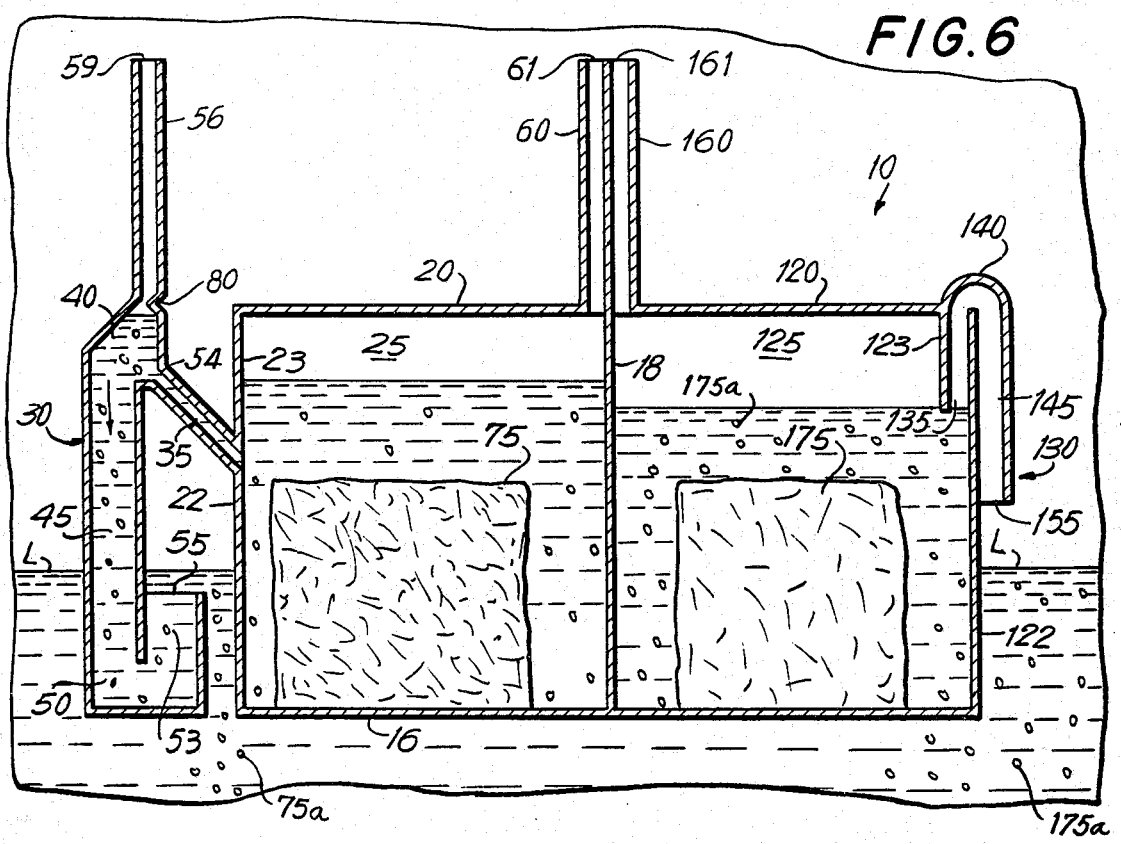

At the same time, as water level L drops rapidly when the toilet is flushed (FIG. 4), in section B, the detergent/deodorant solution 175*a* in product chamber 125 is siphoned out of chamber 125 into the toilet tank through pathway 130. When the liquid level in chamber 125 drops to that of conduit 135 of pathway 130, the seal is broken and flow out of chamber 125 stops (FIG. 6). Thus, a predetermined amount of the detergent deodorant solution is dispensed into the toilet tank from section B of dispenser 10. Similarly, in FIG. 6 the level in chamber 25 has fallen below the upper end 54 of conduit 35, and flow therefrom has terminated. However, flow from the pathway 30 continues.

Figure 7:
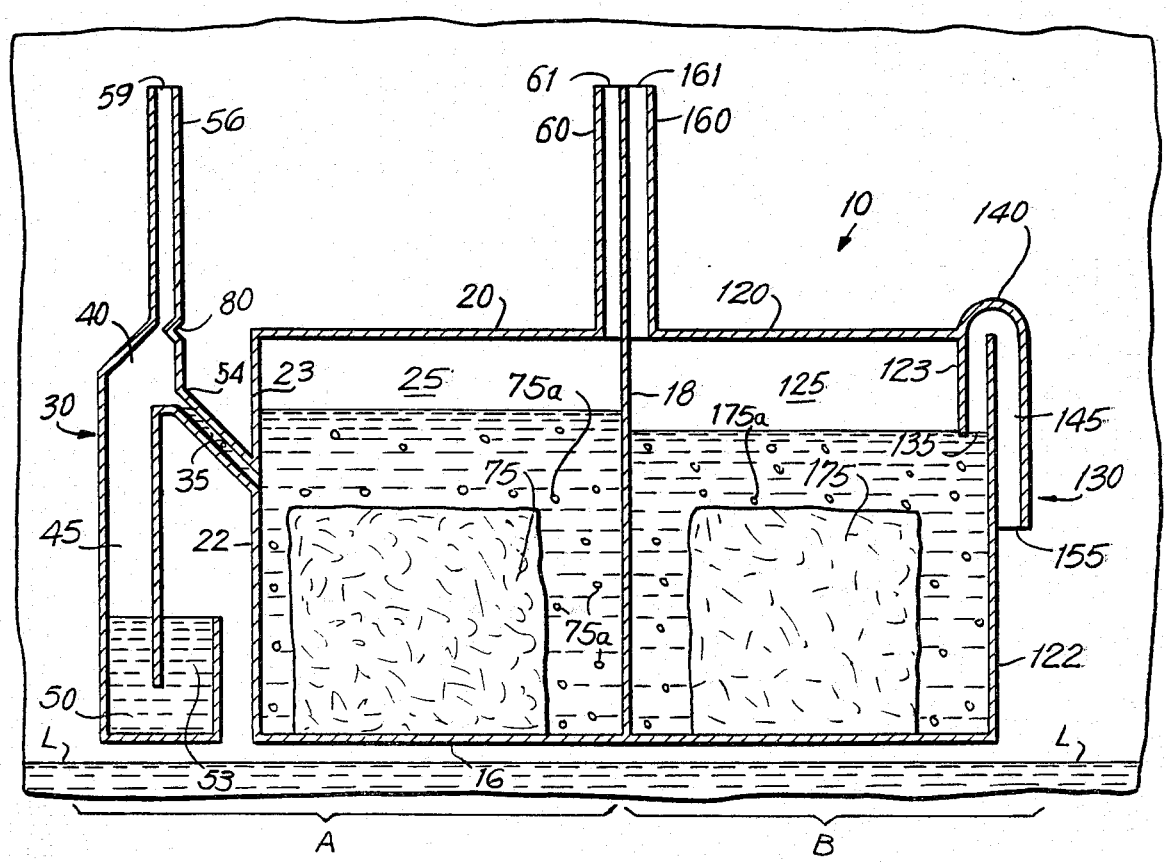

FIG. 7 illustrates the end of the flush cycle after a predetermined amount of the solutions 75*a* and 175*a* have been dispensed into the toilet tank, which solutions flow subsequently into the toilet bowl. The volume of solution 75*a* remaining in chamber 25 is equal to the volume of the chamber 25 below end 54 of the conduit 35 less the volume of the cake 75. Similarly, the volume of solution 175*a* in chamber 125 is equal to the volume of chamber 130 below conduit 135 of pathway 130 less the volume of the cake 175.

Figure 8:
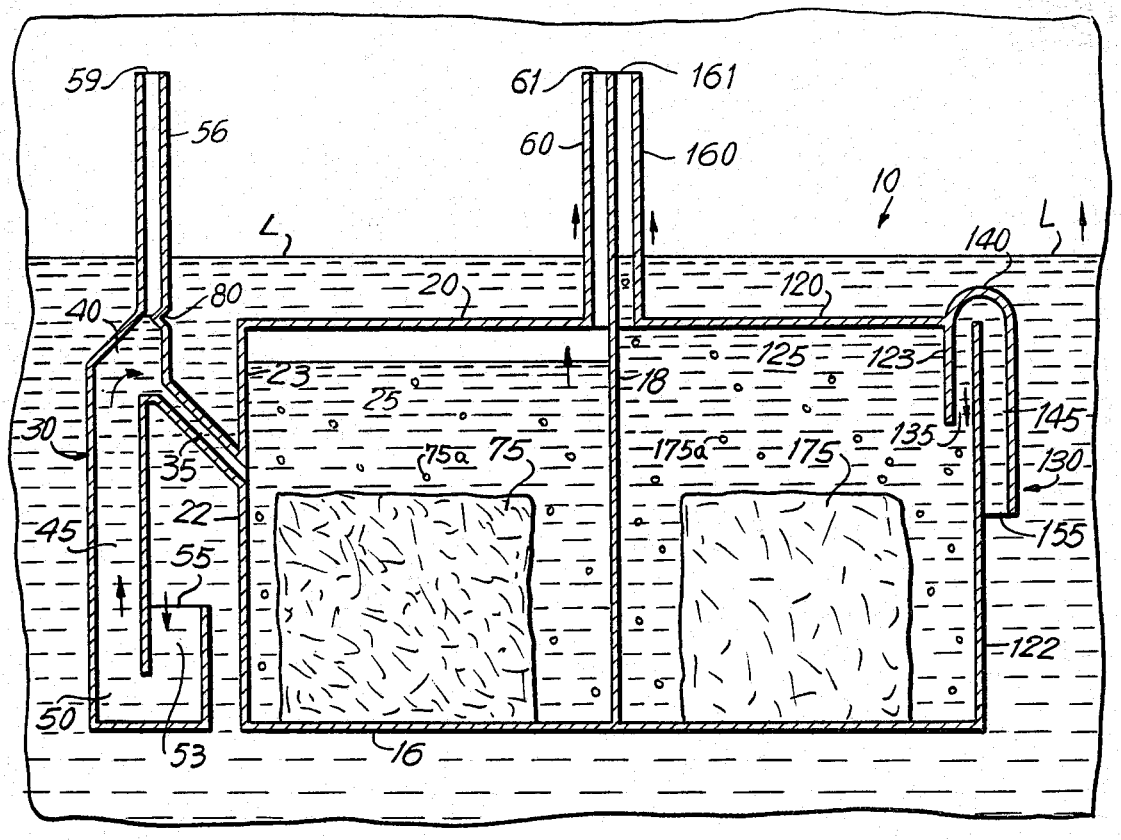

FIG. 8 illustrates an intermediate stage in the refill cycle. As the water level L rises, fresh water enters refill/discharge pathway 30 of section A through exit-/inlet port 55 and into product chamber 25. Because of the presence of constriction 80, refill/discharge pathway 30 fills rapidly thereby flooding portion 40. The positive hydraulic head thus obtained in pathway 30 against constriction 80 provides a pressure driving force toward the product chamber 25 through conduit 35. The added turbulence thus obtained enhances dissolution of the cake 75 and rapid formation of the product solution 75*a*. Not only is a more uniform solution formed within chamber 25, but the solution formed is ready for use soon after the tank is filled as in the case of repeated flushing. Contemporaneous with the filling of section A, rising tank water enters through opening 155 of conduit 145 of pathway 130. When the liquid level in the tank rises to a level above the U-bend 140 in the pathway 130, water enters the chamber 125 through conduit 135.

The utilization of the constriction 80 is not a necessary feature of the invention. Its inclusion is preferred in that it provides the turbulence described in the previous paragraph during the filling of the dispenser. The cross-sectional area of the constriction 80 should be smaller than the cross-sectional area of the inclined conduit 35. The higher pressure drop across the constriction establishes a preferential flow path, accompanied with higher flow velocities, through the conduit 35. An optimum ratio of the cross-sectional area of the constriction to the cross-sectional area of the vent 56 cannot be stated. Furthermore, empirical flow relationships developed for venturi or orifice restrictions would not appear to be entirely valid where, as here, the flow is laminar and the system is in flux. Typically, a ratio of constriction cross-sectional area to venting conduit 56 cross-sectional area in the range of from about 0.01 to about 0.5 is satisfactory to obtain the requisite back pressure. For the same reason, and as part of the preferred embodiment, the components of the refill/discharge pathway 30—the upper portion 40, the central portion 45, the bottom portion 50, and the end portion 53—should each have cross-sectional areas larger than that of the inclined conduit 35. In the most preferred embodiment of the dispenser 10, the cross-sectional area of each component decreases with respect to the preceding component starting from the end portion 53 and ending with the upper portion 40, all of which are greater than the cross-sectional area of inclined conduit 35. The area of constriction 80 is less than that of conduit 35. The individual components may have cross sections of constant area, or the entire pathway can be arcuate in design with interior walls diverging towards the conduit 35.

With respect to section B, diffusion of surfactant solution 175*a* may occur. However, isolation is not essential in view of the anticipated nature of the solution contained in section B. Thus, the solution 175*a* will typically be a non-oxidizing cleansing additive material. Furthermore, isolation is not required as long as a non-compatible component of the dual chemical system is substantially isolated. The isolation of the cleaning agents is thus not warranted, and results in greater cost of manufacture. In addition, cleansing agent additives tend to result in higher viscosity solutions than the disinfectants commonly used.

The present dispenser can be made of any suitable material. Examples of useful materials include thermoformed or molded polyvinylchloride, acrylonitrile-butadiene-styrene copolymer, polyethylene and similar resins.

Figure 9:
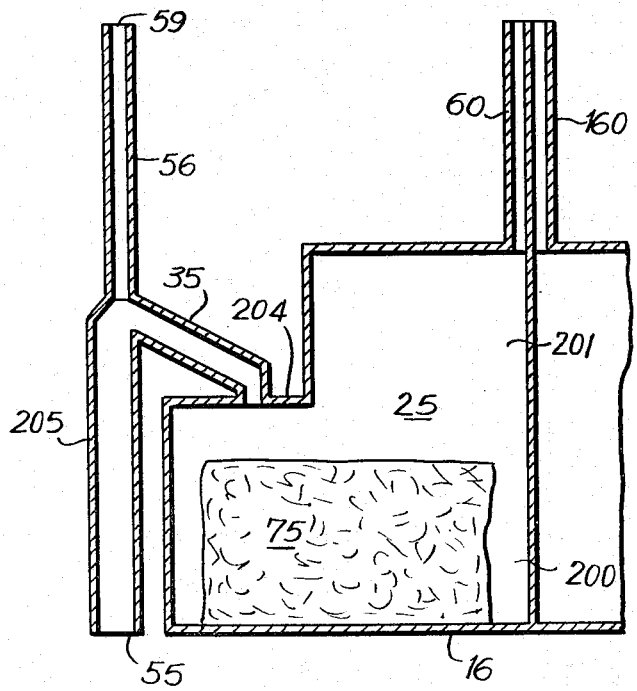
FIG. 9 is an alternate embodiment of section A of the dispenser of the present invention.

FIG. 9 is an alternate embodiment of the section A of the dispenser 10 of the present invention. In FIG. 9 the product chamber 25 comprises a lower portion 200 and an upper portion 201, the upper portion 201 being of smaller width than portion 200 thereby forming a shoulder 204 at the top of the portion 200. Venting means 60 extends from the top of portion 201 to the atmosphere. The refill/discharge pathway comprises a vertical member 205 with an inlet/exit port 55 at the bottom thereof. Venting conduit 56 extends from the top of member 205 to the atmosphere, the constriction being omitted therefrom. Inclined conduit 35 is connected at its upper end to the top side wall of member 205, and at its lower end to the shoulder 204 of chamber 25. The cross-sectional area of vent 56 is much smaller than the cross-sectional area of conduit 35, thereby achieving a jetting action during refill. The lower end of conduit 35 is oriented for nearly vertical discharge into chamber 25 so that the incoming liquid impinges on cake 75.

What is claimed is:

1. A passive dispenser for containing a quantity of a first solution and a second solution and for codispensing a predetermined volume of said first solution and said second solution into a body of liquid in which said passive dispenser is placed, in response to the level of said body of liquid being lowered from a first elevation to a second elevation, the passive dispenser comprising:

a first dispensing section comprising:

a first product chamber, said first chamber containing a water-soluble cake forming, upon dissolution, the first solution;

a vent conduit extending upwardly from the top of the first chamber;

a refill/discharge pathway having an exit/inlet port at the lower end and an inclined conduit at the upper end, the lower end of the inclined conduit entering said first product chamber at a predetermined distance below the top thereof, and a conduit to vent said refill/discharge pathway, said conduit extending upwardly from the top of the refill/discharge pathway, and a second dispensing section in separate relationship from the first, said second dispensing section comprising:

a second product chamber, said second chamber containing a water-soluble cake forming, upon dissolution, the second solution;

a vent conduit extending upwardly from the top of the second chamber, and an inlet/outlet pathway providing fluid communication between said second chamber and the body of liquid, said pathway entering the chamber at a predetermined distance below the top thereof, whereby, when the body of liquid is lowered from the first elevation to the second elevation, a predetermined volume of solution in the first chamber and a predetermined volume of solution in the second chamber is dispensed.

2. A passive dispenser for containing a quantity of a first solution and a second solution and for codispensing a predetermined volume of said first and said second solutions into a body of liquid in which said passive dispenser is placed in response to the level of said body of liquid being lowered from a first elevation to a second elevation, the passive dispenser comprising:

a first dispensing section comprising:

a first product chamber containing a water-soluble disinfectant cake forming, upon dissolution, a disinfectant solution;

a refill/discharge pathway having an exit/inlet port at the lower end and an inclined conduit at the upper end, the lower end of the inclined conduit entering said first product chamber at a predetermined distance below the top thereof;

a conduit to vent said refill/discharge pathway, said conduit extending upwardly from the top of the refill/discharge pathway, and a vent conduit extending upwardly from the top of the first chamber, and a second dispensing section in separate relationship from the first comprising:

a second product chamber containing a water-soluble surfactant cake forming upon dissolution a surfactant solution;

a vent conduit extending upwardly from the top of said second chamber, and an inlet/outlet pathway providing fluid communication between said second chamber and the body of liquid, said pathway entering the second chamber at a predetermined distance below the top thereof and adapted to discharge the volume of surfactant solution thereabove by siphon flow, whereby, when the body of liquid is lowered from the first elevation to the second elevation, predetermined volumes of surfactant and disinfectant solutions are codispensed, the surfactant solution being dispensed from the second dispensing section by siphon flow and the disinfectant solution being dispensed from the first dispensing section by gravity flow.

3. The dispenser of claim 2 wherein said refill/discharge pathway further comprises a main compartment having an upper portion, a vertical central portion, a bottom portion, and a vertical end portion, said portions being in fluid communications with one another, the upper portion being connected to the venting conduit therefor and to the inclined conduit, the exit/inlet port being disposed at the upper end of said vertical end portion.

4. The dispenser of claim 3 wherein the refill/discharge pathway venting conduit is provided with constriction means.

5. The dispenser of claim 4 wherein said constriction means is positioned in said venting conduit proximate the upper portion of said main compartment at a level equal to or above the top of said product chamber.

6. The dispenser of claim 5 wherein the upper end of said inclined conduit is at least ¼ inch above the lower end thereof, said conduit forming an angle of from about 10° to about 80° with respect to the vertical axis.

7. The dispenser of claim 6 wherein the upper end of said inclined conduit is less than about two inches above the lower end.

8. The dispenser of claim 7 wherein the inclined conduit forms an angle of from about 10° to about 60° with respect to the vertical axis.

9. The dispenser of claim 7 wherein the ratio of the cross-sectional area of said constriction to said refill/discharge pathway venting conduit is from about 0.01 to about 0.50.

10. The dispenser of claim 7 wherein the ratio of the cross-sectional area of said constriction to said venting conduit is from about 0.05 to about 0.25.

11. The dispenser of claim 2 wherein said cake contained in the second product chamber is a surfactant cake comprising a surfactant selected from the group of anionic, nonionic, and amphoteric surface active agents, and optional adjuvants selected from the group consisting of dyes, fragrances and buffering agents, and wherein said cake in the first product chamber is a disinfectant cake containing a halogen-releasing agent having a solubility of less than about 5.0 gms./100 gms. of water at 77° F.

12. The dispenser of claim 11 wherein the halogen-releasing agent is selected from the group consisting of N-halogenated hydantoins, chloramine derivatives and isocyanurates having a solubility of less than about 2.0 gms./100 gms. of water at 77° F.

13. The dispenser of claim 12 wherein the halogen-releasing agent is selected from the group consisting of trichloroisocyanuric acid and 1-bromo-3-chloro-5,5-dimethylhydantoin.

14. The dispenser of claim 13 wherein the disinfectant cake comprises at least 30% disinfectant by weight and less than 70% binder therefor.

15. The dispenser of claim 13 wherein the halogen-releasing agent is in agglomerated form.

16. The dispenser of claim 14 wherein the surfactant cake contains a mixed surfactant composition consisting essentially of 1 to 10 parts alpha-olefin sulfonate, 1 to 10 parts alkoxypoly (ethyleneoxy) alcohol, and 0.5 to 5 parts polyoxypropylene polyoxyethylene copolymer condensate.

17. The dispenser of claim 2 further comprising hanging means to suspend the dispenser in the body of liquid.

* * * * *